US008102163B2

(12) United States Patent
Imura

(10) Patent No.: US 8,102,163 B2
(45) Date of Patent: Jan. 24, 2012

(54) VOLTAGE REGULATOR

(75) Inventor: Takashi Imura, Chiba (JP)

(73) Assignee: Seiko Instruments Inc. (JP)

( * ) Notice: Subject to any disclaimer, the term of this patent is extended or adjusted under 35 U.S.C. 154(b) by 418 days.

(21) Appl. No.: 12/455,047

(22) Filed: May 28, 2009

(65) Prior Publication Data

US 2009/0295345 A1 Dec. 3, 2009

(30) Foreign Application Priority Data

May 29, 2008 (JP) ..... 2008-141094

(51) Int. Cl.
*G05F 1/00* (2006.01)

(52) U.S. Cl. ..... 323/280; 323/274

(58) Field of Classification Search ..... 323/280, 323/281, 273, 274
See application file for complete search history.

(56) References Cited

U.S. PATENT DOCUMENTS 4,355,277 A * 10/1982 Davis et al. ..... 323/351
4,437,146 A * 3/1984 Carpenter ..... 323/222
4,442,397 A * 4/1984 Ishikawa et al. ..... 323/275

OTHER PUBLICATIONS

Patent Abstracts of Japan, publication No. 2001-195138, publication date, Jul. 19, 2001.

* cited by examiner

*Primary Examiner* — Shawn Riley
(74) *Attorney, Agent, or Firm* — Adams & Wilks

(57) ABSTRACT

Provided is a voltage regulator which can achieve high-speed response and is not susceptible to a ripple. An amplifier (19) and an amplifier (23) provide push-pull output to an output transistor (14). Therefore, even when an idling current is small, a sink current and a source current with respect to a gate of the output transistor (14) can be increased in a balanced manner. Thus, the voltage regulator can easily achieve high-speed response. In addition, even when the ripple is superimposed on an input voltage, an output voltage is not influenced by the ripple.

5 Claims, 2 Drawing Sheets

VOLTAGE REGULATOR

BACKGROUND OF THE INVENTION

1. Field of the Invention

The present invention relates to a voltage regulator.

2. Description of the Related Art

First, a conventional voltage regulator is described. FIG. 4 is a circuit diagram illustrating the conventional voltage regulator.

The conventional voltage regulator includes an input terminal 71, a ground terminal 72, an output terminal 73, an output transistor 74, a voltage divider circuit 75, a reference voltage circuit 76, an amplifier 77, and a source follower circuit 78.

An operation of the conventional voltage regulator is described. When an output voltage Vout of the output terminal 73 increases, a divided voltage Vfb of the voltage divider circuit 75 increases. When the divided voltage Vfb becomes higher than a reference voltage Vref, a difference therebetween is amplified as an increased component, and hence an output voltage of the amplifier 77 increases. The output voltage of the amplifier 77 is input to a gate of the output transistor 74 through the source follower circuit 78. Then, the output transistor 74 is turned off to reduce the output voltage Vout. Therefore, the output voltage Vout is controlled to a desired constant voltage. Even when the output voltage Vout reduces, the output voltage Vout is controlled to the desired constant voltage in the same manner as described above (see, for example, JP 2001-195138 A).

The source follower circuit 78 operates to remove a ripple of an input voltage Vin.

However, according to the conventional voltage regulator, the source follower circuit drives the output transistor, and therefore an imbalance is created between a sink current and a source current with respect to the gate of the output transistor. Therefore, the conventional voltage regulator cannot achieve high-speed response.

SUMMARY OF THE INVENTION

The present invention has been made in view of the above-mentioned problem. Therefore, an object of the present invention is to provide a voltage regulator which can achieve high-speed response and is not susceptible to a ripple.

In order to solve the above-mentioned problem, the present invention provides a voltage regulator including: an input terminal; a ground terminal; an output terminal; an output transistor provided between the input terminal and the output terminal, for generating an output voltage based on an input voltage and a gate voltage; a voltage divider circuit provided between the output terminal and the ground terminal, for dividing the output voltage to output a divided voltage; a reference voltage circuit for outputting a reference voltage; a first amplifier including a first input terminal provided at an output terminal of the reference voltage circuit and a second input terminal provided at an output terminal of the voltage divider circuit, for controlling the output voltage to a desired constant voltage; a second amplifier including an input terminal provided at an output terminal of the first amplifier and an output terminal provided at a gate of the output transistor; a resistor; a third amplifier including an input terminal provided at the output terminal of the first amplifier through the resistor and an output terminal provided at the gate of the output transistor, for providing push-pull output in cooperation with the second amplifier; and an auxiliary circuit provided at a connection point between the resistor and the input terminal of the third amplifier, for detecting a ripple and operating the third amplifier based on the ripple.

According to the voltage regulator of the present invention, the second amplifier and the third amplifier provide the push-pull output to the output transistor. Therefore, even when an idling current is small, a sink current and a source current with respect to the gate of the output transistor can be increased in a balanced manner. Thus, the voltage regulator can easily achieve high-speed response.

Even when the ripple is superimposed on the input voltage, the output voltage is not influenced by the ripple.

DETAILED DESCRIPTION OF THE PREFERRED EMBODIMENTS

Hereinafter, embodiments of the present invention are described with reference to the attached drawings.

First Embodiment

Figure 1:
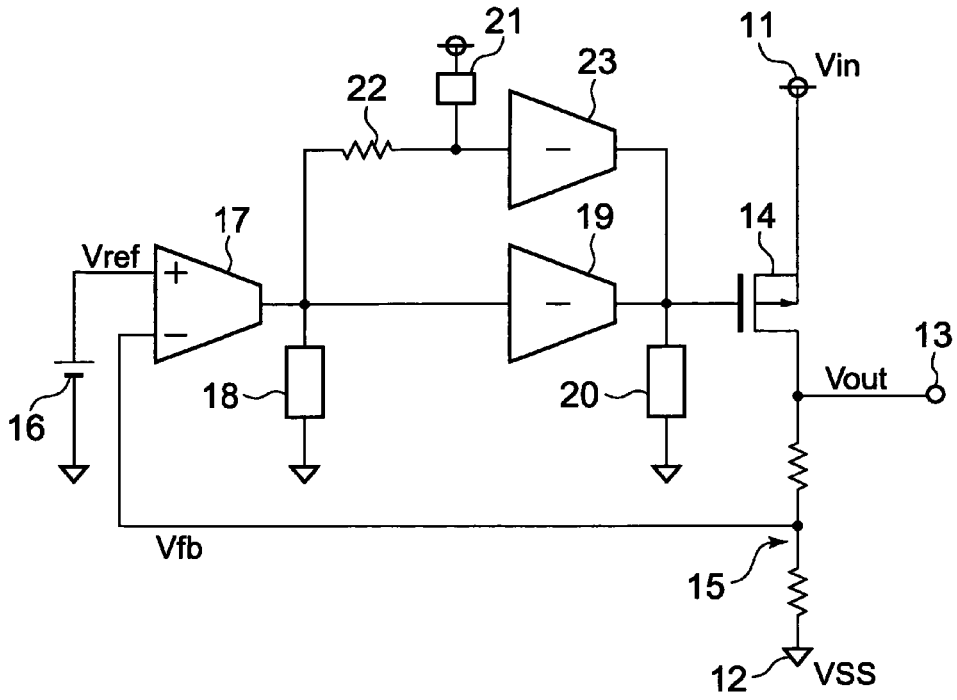
FIG. 1 is a circuit diagram illustrating a voltage regulator according to a first embodiment of the present invention.

A structure of a voltage regulator according to a first embodiment is described. FIG. 1 is a circuit diagram illustrating the voltage regulator according to the first embodiment.

The voltage regulator according to the first embodiment includes an input terminal 11, a ground terminal 12, an output terminal 13, an output transistor 14, a voltage divider circuit 15, a reference voltage circuit 16, an amplifier 17, an admittance element 18, an amplifier 19, an admittance element 20, an auxiliary circuit 21, a resistor 22, and an amplifier 23.

The output transistor 14 has a gate connected to a connection point between an output terminal of the amplifier 19 and one end of the admittance element 20, a source and a back gate which are connected to the input terminal 11, and a drain connected to the output terminal 13. The voltage divider circuit 15 is provided between the output terminal 13 and the ground terminal 12. The reference voltage circuit 16 is provided between a non-inverting input terminal of the amplifier 17 and the ground terminal 12. An inverting input terminal of the amplifier 17 is connected to an output terminal of the voltage divider circuit 15. One end of the admittance element 18 is connected to the ground terminal 12. An input terminal of the amplifier 19 is connected to a connection point between an output terminal of the amplifier 17 and the other end of the admittance element 18. The other end of the admittance element 20 is connected to the ground terminal 12. The amplifier 23 has an input terminal connected to a connection point between an output terminal of the auxiliary circuit 21 and one end of the resistor 22, and an output terminal connected to the connection point between the output terminal of the amplifier 19 and the one end of the admittance element 20. An input terminal of the auxiliary circuit 21 is connected to the input terminal 11. The other end of the resistor 22 is connected to the connection point between the output terminal of the amplifier 17 and the other end of the admittance element 18.

The admittance element 18 is a parallel connection circuit which includes an output resistor of the amplifier 17 and a parasitic capacitor at the node of the output terminal of the amplifier 17.

The admittance element 20 is a parallel connection circuit which includes an output resistor of the amplifier 19, an output resistor of the amplifier 23, and a parasitic capacitor at the node of the output terminal of the amplifier 19.

The auxiliary circuit 21 is, for example, a capacitor (not shown).

In the amplifier 17, when a divided voltage Vfb becomes higher than a reference voltage Vref, a difference therebetween is amplified as an increased component and an output current becomes smaller, and hence an output voltage is reduced by the output current and the admittance element 18. When the divided voltage Vfb becomes lower than the reference voltage Vref, a difference therebetween is amplified as a reduced component and the output current becomes larger, and hence the output voltage increases.

The amplifiers 19 and 23 provide push-pull output. When the input voltage increases, an increased component is inverting-amplified and an output current becomes smaller, and hence an output voltage is reduced by the output current and the admittance element 20. When the input voltage reduces, a reduced component is inverting-amplified and the output current becomes larger, and hence the output voltage increases.

Next, an operation of the voltage regulator is described.

The output transistor 14 outputs an output voltage Vout based on an input voltage Vin and a gate voltage. The voltage divider circuit 15 receives the output voltage Vout, divides the output voltage Vout, and outputs the divided voltage Vfb. The reference voltage circuit 16 outputs the reference voltage Vref. The amplifier 17 controls the output voltage Vout to a desired constant voltage. The auxiliary circuit 21 detects a ripple and causes the amplifier 23 to operate based on the ripple.

First, an operation in a case where no ripple is superimposed on the input voltage Vin is described.

When the output voltage Vout increases, the divided voltage Vfb increases. When the divided voltage Vfb becomes higher than the reference voltage Vref, a difference therebetween is amplified as an increased component, and hence the output voltage of the amplifier 17 reduces. When the output voltage of the amplifier 17 reduces, a reduced component is amplified and the gate voltage of the output transistor 14 increases. When the output voltage of the amplifier 17 further reduces, a reduced component is amplified and the gate voltage of the output transistor 14 further increases. Then, the output transistor is turned off to reduce the output voltage Vout. Therefore, the output voltage Vout is controlled to the desired constant voltage.

Even when the output voltage Vout reduces, the output voltage Vout is controlled to the desired constant voltage in the same manner as described above.

Next, an operation in a case where a ripple is superimposed on the input voltage Vin and thus the output voltage Vout becomes higher is described.

When the ripple is superimposed on the input voltage Vin, the output voltage Vout is increased because of the ripple, and the divided voltage Vfb becomes higher. When the divided voltage Vfb becomes higher than the reference voltage Vref, a difference therebetween is amplified as an increased component, and hence the output voltage of the amplifier 17 reduces. When the output voltage of the amplifier 17 reduces, a reduction component is amplified and the gate voltage of the output transistor 14 increases. In addition, the ripple superimposed on the input voltage Vin is detected by the auxiliary circuit 21 and an input voltage of the amplifier 23 increases. When the input voltage of the amplifier 23 increases, an increased component is amplified and the gate voltage of the output transistor 14 reduces. In this case, in order to cancel the influence of the ripple at the output terminal 13 when the ripple is superimposed on the input voltage Vin, the amount of reduction of the gate voltage of the output transistor 14 which is produced by the amplifier 23 and the amount of increase of the gate voltage of the output transistor 14 which is produced by the amplifier 19 are circuit-designed. Therefore, the output voltage Vout is not influenced by the ripple.

Even when the ripple is superimposed on the input voltage Vin and thus the output voltage Vout becomes lower, the output voltage Vout is not influenced by the ripple in the same manner as described above.

As described above, the amplifier 19 and the amplifier 23 provide the push-pull output to the output transistor 14. Therefore, even when an idling current is small, a sink current and a source current with respect to the gate of the output transistor 14 can be increased in a balanced manner. Thus, the voltage regulator can easily achieve high-speed response.

The amplifier 23 and the amplifier 19 are designed to cancel the influence of the ripple at the output terminal 13 when the ripple is superimposed on the input voltage Vin, and therefore the output voltage Vout is not influenced by the ripple.

Even when the auxiliary circuit 21 is provided on a path for controlling the output transistor 14 by the amplifier 17, a phase of the output voltage Vout is not influenced because of the resistor 22.

The admittance element 18 converts the output current signal of the amplifier 17 into the output voltage signal. The admittance element 20 converts the output current signal of each of the amplifiers 19 and 23 into the output voltage signal. Therefore, the admittance element 18 and the admittance element 20 are connected to the ground terminal 12. Note that the admittance element 18 and the admittance element 20 may be connected to the input terminal 11 which is an alternating current ground terminal.

The auxiliary circuit 21 is connected to the input terminal 11. When the amplifier 19 and the amplifier 23 are operated based on the input voltage Vin, the auxiliary circuit 21 may be connected to the ground terminal 12.

Second Embodiment

Figure 2:
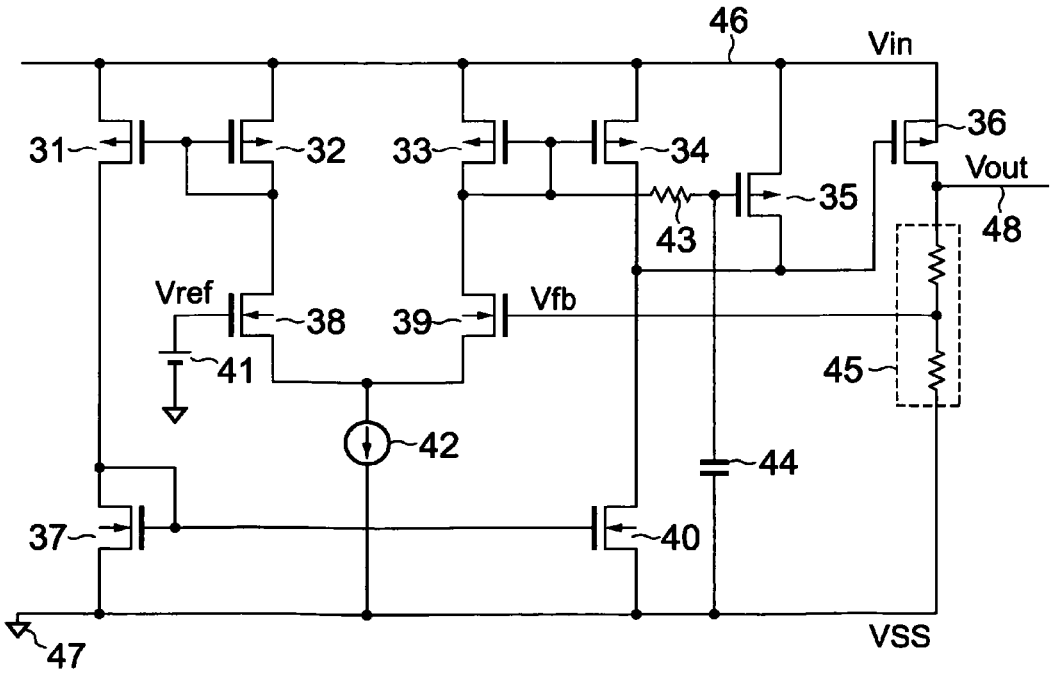
FIG. 2 is a circuit diagram illustrating a voltage regulator according to a second embodiment of the present invention.

A structure of a voltage regulator according to a second embodiment is described. FIG. 2 is a circuit diagram illustrating the voltage regulator according to the second embodiment.

The voltage regulator according to the second embodiment includes PMOS transistors 31 to 35, an output transistor 36, NMOS transistors 37 to 40, a reference voltage circuit 41, a constant current circuit 42, a resistor 43, a capacitor 44, a voltage divider circuit 45, an input terminal 46, a ground terminal 47, and an output terminal 48.

A gate of the PMOS transistor 31 is connected to a gate of the PMOS transistor 32, a source thereof is connected to the input terminal 46, and a drain thereof is connected to a drain of the NMOS transistor 37. A source of the PMOS transistor 32 is connected to the input terminal 46, and a drain and a gate thereof are connected to each other. A gate of the PMOS transistor 33 is connected to a drain thereof, and a source thereof is connected to the input terminal 46. A gate of the PMOS transistor 34 is connected to the gate of the PMOS transistor 33, a source thereof is connected to the input terminal 46, and a drain thereof is connected to a drain of the NMOS transistor 40. A gate of the PMOS transistor 35 is connected to the gate of the PMOS transistor 33 through the resistor 43, a source thereof is connected to the input terminal 46, and a drain thereof is connected to the drain of the NMOS transistor 40. The capacitor 44 is provided between the ground terminal 47 and a connection point between the resistor 43 and the PMOS transistor 35. A gate of the output transistor 36 is connected to the drain of the PMOS transistor 34, a source thereof is connected to the input terminal 46, and a drain thereof is connected to the output terminal 48.

A gate of the NMOS transistor 37 is connected to a drain thereof and a source thereof is connected to the ground terminal 47. The reference voltage circuit 41 is provided between a gate of the NMOS transistor 38 and the ground terminal 47. The constant current circuit 42 is provided between the ground terminal 47 and a connection point between a source of the NMOS transistor 38 and a source of the NMOS transistor 39. A drain of the NMOS transistor 38 is connected to the drain of the PMOS transistor 32. A gate of the NMOS transistor 39 is connected to an output terminal of the voltage divider circuit 45 and a drain thereof is connected to the drain of the PMOS transistor 33. A gate of the NMOS transistor 40 is connected to the gate of the NMOS transistor 37 and a source thereof is connected to the ground terminal 47. The voltage divider circuit 45 is provided between the output terminal 48 and the ground terminal 47.

The PMOS transistors 32 and 33, the NMOS transistors 38 and 39, the reference voltage circuit 41, and the constant current circuit 42 serve as a first amplifier. The PMOS transistors 31 and 34 and the NMOS transistors 37 and 40 serve as a second amplifier. An input terminal of the second amplifier corresponds to the gates of the PMOS transistors 31 and 34 and an output terminal thereof corresponds to the drain of the PMOS transistor 34 and the drain of the NMOS transistor 40. The PMOS transistor 35 serves as a third amplifier. An input terminal of the third amplifier corresponds to the gate of the PMOS transistor 35 and an output terminal thereof corresponds to the drain of the PMOS transistor 35. The third amplifier provides push-pull output to the output transistor 36 in cooperation with the second amplifier.

Next, an operation of the voltage regulator is described.

The output transistor 36 outputs an output voltage Vout based on an input voltage Vin and a gate voltage. The voltage divider circuit 45 receives the output voltage Vout, divides the output voltage Vout, and outputs the divided voltage Vfb. The reference voltage circuit 41 outputs the reference voltage Vref. The first amplifier controls the output voltage Vout to a desired constant voltage.

First, an operation in a case where no ripple is superimposed on the input voltage Vin is described.

When the output voltage Vout increases, the divided voltage Vfb increases. When the divided voltage Vfb becomes higher than the reference voltage Vref, a drain current of the NMOS transistor 39 becomes larger than a drain current of the NMOS transistor 38. Then, because of the current mirror circuit, a drain current of the PMOS transistor 34 increases and a drain current of the NMOS transistor 40 reduces. A gate voltage of the PMOS transistor 35 reduces to turn on the NMOS transistor 35. Then, a gate voltage of the output transistor 36 increases to turn off the output transistor 36, thereby lowering the output voltage Vout. Therefore, the output voltage Vout is controlled to the desired constant voltage.

Even when the output voltage Vout reduces, the output voltage Vout is controlled to the desired constant voltage in the same manner as described above.

Next, an operation in a case where a ripple is superimposed on the input voltage Vin is described.

When the ripple is superimposed on the input voltage Vin, the ripple causes a variation in gate-source voltage of the PMOS transistor 34 and a variation in source-drain voltage of the PMOS transistor 34. Therefore, the operation of the PMOS transistor 34 changes.

However, because of the ripple, the operation of the PMOS transistor 35 is changed by the capacitor 44, and hence the PMOS transistor 35 operates so as to cancel the variation in operation of the PMOS transistor 34 which is caused by the ripple. Therefore, the output voltage Vout is not influenced by the ripple.

As described above, the second amplifier and the third amplifier provide the push-pull output to the output transistor 36. Therefore, even when an idling current is small, a sink current and a source current with respect to the gate of the output transistor 36 can be increased in a balanced manner. Thus, the voltage regulator can easily achieve high-speed response.

Further, the PMOS transistor 35 operates so as to cancel the variation in operation of the PMOS transistor 34 which is caused by the ripple. Therefore, the output voltage Vout is not influenced by the ripple.

Even when the capacitor 44 is provided on a path for controlling the output transistor 36 by the first amplifier, a phase of the output voltage Vout is not influenced because of the resistor 43.

Note that a resistor (not shown) may be connected in series with the capacitor 44. Alternatively, a resistor (not shown) may be connected in parallel with the capacitor 44.

Third Embodiment

Figure 3:
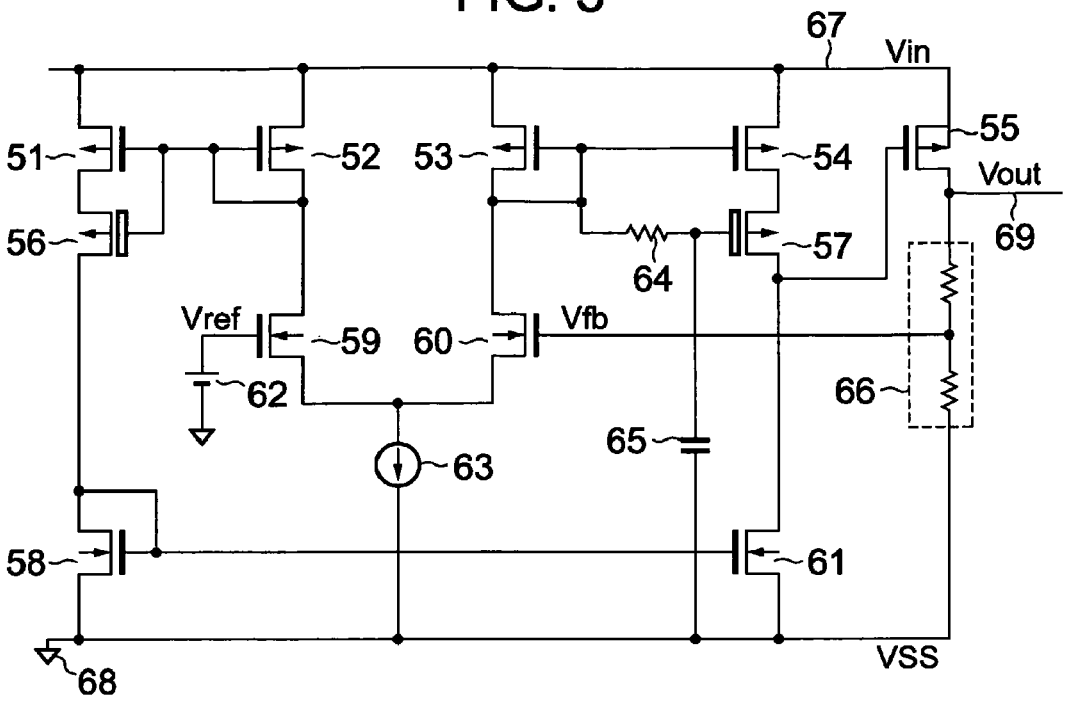
FIG. 3 is a circuit diagram illustrating a voltage regulator according to a third embodiment of the present invention.
Figure 4:
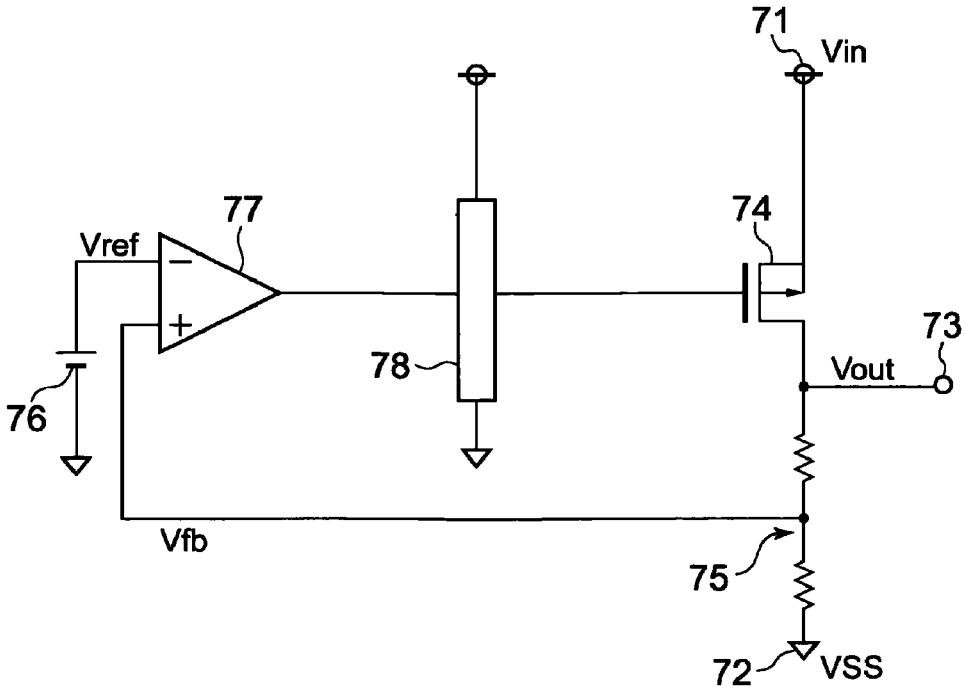
FIG. 4 PRIOR ART
FIG. 4 is a circuit diagram illustrating a conventional voltage regulator.

A structure of a voltage regulator according to a third embodiment is described. FIG. 3 is a circuit diagram illustrating the voltage regulator according to the second embodiment.

The voltage regulator according to the third embodiment includes PMOS transistors 51 to 54, an output transistor 55, PMOS transistors 56 and 57, NMOS transistors 58 to 61, a reference voltage circuit 62, a constant current circuit 63, a resistor 64, a capacitor 65, a voltage divider circuit 66, an input terminal 67, a ground terminal 68, and an output terminal 69.

A gate of the PMOS transistor 51 is connected to a gate of the PMOS transistor 52, a source thereof is connected to the input terminal 67, and a drain thereof is connected to a source of the NMOS transistor 56. A gate of the PMOS transistor 56 is connected to the gate of the PMOS transistor 51 and a drain thereof is connected to a drain of the NMOS transistor 58. A source of the PMOS transistor 52 is connected to the input terminal 67, and a drain and a gate thereof is connected to each other. A gate of the PMOS transistor 53 is connected to a gate of the PMOS transistor 54, a source thereof is connected to the input terminal 67, and a drain and the gate thereof is connected to each other. A source of the PMOS transistor 54 is connected to the input terminal 67, and a drain thereof is connected to a source of the PMOS transistor 57. A gate of the PMOS transistor 57 is connected to the gate of the PMOS transistor 53 through the resistor 64 and a drain thereof is connected to the drain of the NMOS transistor 61. The capacitor 65 is provided between the ground terminal 68 and a connection point between the resistor 64 and the PMOS transistor 57. A gate of the output transistor 55 is connected to the drain of the PMOS transistor 57, a source thereof is connected to the input terminal 67, and a drain thereof is connected to the output terminal 69.

A gate of the NMOS transistor 58 is connected to a drain thereof and a source thereof is connected to the ground terminal 68. The reference voltage circuit 62 is provided between a gate of the NMOS transistor 59 and the ground terminal 68. The constant current circuit 63 is provided between the ground terminal 68 and a connection point between a source of the NMOS transistor 59 and a source of the NMOS transistor 60. A drain of the NMOS transistor 59 is connected to the drain of the PMOS transistor 52. A gate of the NMOS transistor 60 is connected to an output terminal of the voltage divider circuit 66 and a drain thereof is connected to the drain of the PMOS transistor 53. A gate of the NMOS transistor 61 is connected to the gate of the NMOS transistor 58 and a source thereof is connected to the ground terminal 68. The voltage divider circuit 66 is provided between the output terminal 69 and the ground terminal 68.

The PMOS transistors 52 and 53, the NMOS transistors 59 and 60, the reference voltage circuit 62, and the constant current circuit 63 serve as a first amplifier. The PMOS transistors 51, 54, 56, and 57, and the NMOS transistors 58 and 61 serve as a second amplifier. First input terminal of the second amplifier corresponds to the gates of the PMOS transistors 51 and 54, second input terminal thereof corresponds to the gates of the PMOS transistor 57, and an output terminal thereof corresponds to the drain of the PMOS transistor 34 and the drain of the NMOS transistor 61. The second amplifier provides push-pull output to the output transistor 55.

The PMOS transistors 56 and 57 are circuit-designed so as to be lower in threshold voltage than the PMOS transistors 51 and 54. Alternatively, the PMOS transistors 56 and 57 are circuit-designed so as to be larger in transfer conductance than the PMOS transistors 51 and 54. Therefore, the PMOS transistors 51, 54, 56, and 57 easily operate in a saturation region.

Next, an operation of the voltage regulator is described.

The output transistor 55 outputs an output voltage Vout based on an input voltage Vin and a gate voltage. The voltage divider circuit 66 receives the output voltage Vout, divides the output voltage Vout, and outputs the divided voltage Vfb. The reference voltage circuit 62 outputs the reference voltage Vref. The first amplifier controls the output voltage Vout to a desired constant voltage.

First, an operation in a case where no ripple is superimposed on the input voltage Vin is described.

When the output voltage Vout increases, the divided voltage Vfb increases. When the divided voltage Vfb becomes higher than the reference voltage Vref, a drain current of the NMOS transistor 60 becomes larger than a drain current of the NMOS transistor 59. Then, because of the current mirror circuit, a drain current of the PMOS transistor 54 and a drain current of the PMOS transistor 57 increase and a drain current of the NMOS transistor 61 reduces. Then, a gate voltage of the output transistor 55 increases to turn off the output transistor 55, thereby lowering the output voltage Vout. Therefore, the output voltage Vout is controlled to the desired constant voltage.

Even when the output voltage Vout reduces, the output voltage Vout is controlled to the desired constant voltage in the same manner as described above.

Next, an operation in a case where a ripple is superimposed on the input voltage Vin is described.

When the ripple is superimposed on the input voltage Vin, the ripple causes a variation in gate-source voltage of the PMOS transistor 54 and a variation in source-drain voltage of the PMOS transistor 54. Therefore, the operation of the PMOS transistor 54 changes.

However, because of the ripple, the operation of the PMOS transistor 57 is changed by the capacitor 65, and hence the PMOS transistor 57 operates so as to cancel the variation in operation of the PMOS transistor 54 which is caused by the ripple. Therefore, the output voltage Vout is not influenced by the ripple.

As described above, the second amplifier provides the push-pull output to the output transistor 55. Therefore, even when an idling current is small, a sink current and a source current with respect to the gate of the output transistor 55 can be increased in a balanced manner. Thus, the voltage regulator can easily achieve high-speed response.

Further, the PMOS transistor 57 operates so as to cancel the variation in operation of the PMOS transistor 54 which is caused by the ripple. Therefore, the output voltage Vout is not influenced by the ripple.

Even when the capacitor 65 is provided on a path for controlling the output transistor 55 by the first amplifier, a phase of the output voltage Vout is not influenced because of the resistor 64.

Note that a resistor (not shown) may be connected in series with the capacitor 65. Alternatively, a resistor (not shown) may be connected in parallel with the capacitor 65.

What is claimed is:

1. A voltage regulator, comprising:

an input terminal;

a ground terminal;

an output terminal;

an output transistor provided between the input terminal and the output terminal, for generating an output voltage based on an input voltage and a gate voltage;

a voltage divider circuit provided between the output terminal and the ground terminal, for dividing the output voltage to output a divided voltage;

a reference voltage circuit for outputting a reference voltage;

a first amplifier including a first input terminal provided at an output terminal of the reference voltage circuit and a second input terminal provided at an output terminal of the voltage divider circuit, for controlling the output voltage to a desired constant voltage;

a second amplifier including an input terminal provided at an output terminal of the first amplifier and an output terminal provided at a gate of the output transistor;

a resistor;

a third amplifier including an input terminal provided at the output terminal of the first amplifier through the resistor and an output terminal provided at the gate of the output transistor, for providing push-pull output in cooperation with the second amplifier; and an auxiliary circuit provided at a connection point between the resistor and the input terminal of the third amplifier, for detecting a ripple and operating the third amplifier based on the ripple.

2. A voltage regulator, comprising:

an input terminal;

a ground terminal;

an output terminal;

an output transistor provided between the input terminal and the output terminal, for generating an output voltage based on an input voltage and a gate voltage;

a voltage divider circuit provided between the output terminal and the ground terminal, for receiving and dividing the output voltage to output a divided voltage;

a reference voltage circuit for outputting a reference voltage;

a first amplifier including a first input terminal provided at an output terminal of the reference voltage circuit and a second input terminal provided at an output terminal of the voltage divider circuit, for controlling the output voltage to a desired constant voltage;

a second amplifier including an input terminal provided at an output terminal of the first amplifier and an output terminal provided at a gate of the output transistor;

a resistor;

a third amplifier including an input terminal provided at the output terminal of the first amplifier through the resistor and an output terminal provided at the gate of the output transistor, for providing push-pull output in cooperation with the second amplifier; and a capacitor provided between the ground terminal and a connection point between the resistor and the input terminal of the third amplifier.

3. A voltage regulator according to claim 2, wherein the third amplifier comprises a PMOS transistor including a gate connected to the output terminal of the first amplifier through the resistor, a source connected to the input terminal, and a drain connected to the gate of the output transistor.

4. A voltage regulator, comprising:

an input terminal;

a ground terminal;

an output terminal;

an output transistor provided between the input terminal and the output terminal, for generating an output voltage based on an input voltage and a gate voltage;

a voltage divider circuit provided between the output terminal and the ground terminal, for receiving and dividing the output voltage to output a divided voltage;

a reference voltage circuit for outputting a reference voltage;

a first amplifier including a first input terminal provided at an output terminal of the reference voltage circuit and a second input terminal provided at an output terminal of the voltage divider circuit, for controlling the output voltage to a desired constant voltage;

a resistor;

a second amplifier including a first input terminal provided at an output terminal of the first amplifier, a second input terminal provided at the output terminal of the first amplifier through the resistor, and an output terminal provided at a gate of the output transistor, for providing push-pull output; and a capacitor provided between the ground terminal and a connection point between the resistor and the second input terminal of the second amplifier.

5. A voltage regulator according to claim 4, wherein the second amplifier comprises an output stage including:

a first PMOS transistor including a gate connected to the output terminal of the first amplifier and a source connected to the input terminal;

a second PMOS transistor including a gate connected to the output terminal of the first amplifier through the resistor, a source connected to a drain of the first PMOS transistor, and a drain connected to the gate of the output transistor; and an NMOS transistor for providing the push-pull output together with the first PMOS transistor and the second PMOS transistor.

* * * * *